US007297041B2

(12) United States Patent
Eden et al.

(10) Patent No.: US 7,297,041 B2
(45) Date of Patent: Nov. 20, 2007

(54) METHOD OF MANUFACTURING MICRODISCHARGE DEVICES WITH ENCAPSULATED ELECTRODES

(75) Inventors: J. Gary Eden, Mahomet, IL (US); Sung-Jin Park, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 434 days.

(21) Appl. No.: 10/958,174

(22) Filed: Oct. 4, 2004

(65) Prior Publication Data

US 2006/0071598 A1 Apr. 6, 2006

(51) Int. Cl.
*H01J 9/00* (2006.01)

(52) U.S. Cl. ..... 445/46; 445/35; 445/51

(58) Field of Classification Search ..... 313/631, 313/306, 356, 586, 613; 445/35, 46, 51
See application file for complete search history.

(56) References Cited

U.S. PATENT DOCUMENTS

| | | | |
|---|---|---|---|
| 3,487,254 | A | 12/1969 | Vollmer |
| 3,697,797 | A | 10/1972 | Freyheit et al. |
| 3,793,552 | A | 2/1974 | Glascock et al. |
| 3,908,147 | A | 9/1975 | Hall et al. |
| 3,970,887 | A | 7/1976 | Smith et al. |
| 4,060,748 | A | 11/1977 | Bayless |
| 4,370,797 | A | 2/1983 | van Gorkom et al. |
| 4,459,636 | A | 7/1984 | Meister et al. |
| 4,672,624 | A | 6/1987 | Ford |
| 4,698,546 | A | 10/1987 | Maitland et al. |
| 4,808,883 | A | 2/1989 | Iwaya et al. |
| 4,890,031 | A | 12/1989 | Zwier |
| 4,988,918 | A | 1/1991 | Mori et al. |
| 4,992,703 | A | 2/1991 | Ramaiah |
| 5,013,902 | A | 5/1991 | Allard |
| 5,055,979 | A | 10/1991 | Boland et al. |
| 5,062,116 | A | 10/1991 | Christensen |
| 5,200,973 | A | 4/1993 | Ford |
| 5,387,805 | A | 2/1995 | Metzler et al. |

(Continued)

FOREIGN PATENT DOCUMENTS

EP 1486775 A * 12/2004

(Continued)

OTHER PUBLICATIONS

A.. El-Habachi, et al., Sep. 15, 2000, "Series operation of direct current xenon chloride excimer sources," Journal of Applied Physics, vol. 88, No. 6, pp. 3220-3224.

(Continued)

*Primary Examiner*—Nimeshkumar D. Patel
*Assistant Examiner*—Kevin Quarterman
(74) *Attorney, Agent, or Firm*—Greer, Burns & Crain, Ltd

(57) ABSTRACT

A method for fabricating dielectric encapsulated electrodes. The process includes anodizing a metal to form a dielectric layer with columnar micropores; dissolving a portion of the dielectric layer and then anodizing the resultant structure a second time. The nanoporous structure that results can provide properties superior to those of conventional dielectric encapsulated metals. The pores of the dielectric may be backfilled with one or more materials to further tailor the properties of the dielectric.

7 Claims, 6 Drawing Sheets

U.S. PATENT DOCUMENTS

| | | | | |
|---|---|---|---|---|
| 5,438,343 | A | 8/1995 | Khan et al. | |
| 5,496,199 | A | 3/1996 | Makishima et al. | |
| 5,514,847 | A | 5/1996 | Makishima et al. | |
| 5,686,789 | A | 11/1997 | Schoenbach et al. | |
| 5,926,496 | A | 7/1999 | Ho et al. | |
| 5,939,829 | A | 8/1999 | Schoenbach et al. | |
| 5,990,620 | A | 11/1999 | Lepselter | |
| 6,016,027 | A | 1/2000 | DeTemple et al. | |
| 6,082,294 | A | 7/2000 | Simpson | |
| 6,139,384 | A | 10/2000 | DeTemple et al. | |
| 6,194,833 | B1 | 2/2001 | DeTemple et al. | |
| 6,346,770 | B1 | 2/2002 | Schoenbach et al. | |
| 6,353,289 | B1 | 3/2002 | Ishigami et al. | |
| 6,433,480 | B1 | 8/2002 | Stark et al. | |
| 6,541,915 | B2 | 4/2003 | Eden et al. | |
| 6,563,257 | B2 | 5/2003 | Vojak et al. | |
| 6,695,664 | B2 | 2/2004 | Eden et al. | |
| 6,815,891 | B2 | 11/2004 | Eden et al. | |
| 6,828,730 | B2 | 12/2004 | Eden et al. | |
| 6,867,548 | B2 | 3/2005 | Eden et al. | |
| 2004/0134778 | A1 * | 7/2004 | Stelzle et al. | 204/403.01 |
| 2005/0136609 | A1 * | 6/2005 | Mosley et al. | 438/381 |

FOREIGN PATENT DOCUMENTS

| | | | |
|---|---|---|---|
| JP | 7192701 | | 7/1995 |
| WO | WO 2004032176 | A1 * | 4/2004 |

OTHER PUBLICATIONS

K. H. Schoenbach , et al, Jan. 1996., "Microhollow cathode discharges," Appl. Phys. Lett., vol. 68, No. 1, pp. 13-15.

L. D. Biborosch, et al, Dec. 20, 1999, "Microdischarges with plane cathodes," Appl. Phys. Lett., vol. 75, No. 25, Dec. 20, 1999, pp. 3926-3928.

S. J. Park, et al, Jul. 10, 2000, "Flexible microdischarge arrays: Metal/polymer devices", Applied Physics Letters, vol. 77, No. 2, pp. 199-201.

J.W. Frame et al., Sep. 1997, "Microdischarge devices fabricated in silicon," Applied Physics Letters, vol. 71, No. 9, pp. 1165-1167.

J.W. Frame,et al., May 25, 1998, "Continuous-wave emission in the ultraviolet from diatomic excimers in a microdischarge", Applied Physics Letters, vol. 72, No. 21, pp. 2634-2636.

J.W. Frame et al., Jul. 23, 1998, "Planar microdischarge arrays", Electronics Letters, vol. 34, No. 15, pp. 1529-1531.

Karl H. Schoenbach et al, Jun. 30, 1997, "High-pressure hollow cathode discharges; "; Plasma Sources Sci Technical., pp. 468-477.

A. El-Habachi, et al, Jan. 5, 1998, "Emission of excimer radiation from direct current, high-pressure hollow cathode discharges;"; App. Phys. Lett. 72 (1), pp. 22-24.

S. J. Park et al., Jan. 2001, "Performance of microdischarge devices and arrays with screen electrodes," IEEE Photon, Tech. Lett., vol. 13, pp. 61-63.

C. J. Wagner, et al., Feb. 12, 2001, "Excitation of a microdischarge with a reverse-biased pn junction," Appl. Phys. Lett., vol. 78, pp. 709-711.

S. J. Park et al., Sep. 24, 2001, "Independently addressable subarrays of silicon microdischarge devices: Electrical characteristics of large (30× 30) arrays and excitation of a phosphor," Appl. Phys. Lett., vol. 79, pp. 2100-2102.

B.A. Voyak, et al., Mar. 5, 2001, "Multistage, monolithic ceramic microdischarge device having an active length of -0.27 mm," Appl. Phys. Lett., vol. 78, No. 10, pp. 1340-1342.

R. H. Stark et. al., Feb. 15, 1999, "Direct current high-pressure glow discharges", J. Appl. Phys. vol. 85, pp. 2075-2080.

J.F. Waymouth, Dec. 1991, "LTE and Near-LTE Lighting Plasmas", IEEE Transaction on Plasma Science, Vo. 19 No. 6 pp. 1003-1012.

A.D. White, May 1959, "New Hollow Cathode Glow Discharge", Journal of Applied Physics, vol. 30, No. 5, pp. 711-719.

L.C. Pitchford, et al., Jul. 1997, "The breakdown and glow phases during the initiation of discharges for lamps", J. Appl. Phys. 82, (1) pp. 112-119.

S. J.Park et al., Feb. 1, 2001, "Arrays of microdischarge devices having 50-100um square pyramidal Si anodes and screen cathodes," 1 Electron. Lett. . vol. 37 No. 3, pp. 171-172.

J.G. Eden et al., Nov. 2003, "Microplasma devices fabricated in silicon, ceramic, and metal/polymer structures: arrays, emitters and photodetectors," Journal of Physics *D: Applied Physics*36, p. 2869-2877.

S. J. Park et al., May 31, 2004, "Carbon nanotube-enhanced performance of microplasma devices," Applied Physics Letters, pp. 4481-4483, vol. 84, No. 22.

H. Masuda; et al., Jun. 9, 1995, "Ordered Metal Nanohole Arrays Made by a Two-Step Replication of Honeycomb Structures of Anodic Alumina", Science, New Series, vol. 268, No. 5216, 1466-1468.

O. Jessensky et al., Mar. 9, 1998, "Self-organized formation of hexagonal pore arrays in anodic alumina", Applied Physics Letters, vol. 72 No. 10., 1173-1175.

R. H. Stark et al., Jun. 21, 1999, "Direct current glow discharges in atmospheric air," Appl. Phys. Lett., vol. 74, pp. 3770-3772.

S.-J. Park et al., Jan. 22, 2001, "Silicon microdischarge devices having inverted pyramidal cathodes: Fabrication and performance of arrays," Appl. Phys. Lett., vol. 78, pp. 419-421.

A.-A. H. Mohamed, et al., Feb. 2002, "Direct current glow discharges in atmospheric air," IEEE Trans. Plasma Sci., vol. 30, pp. 182-183.

* cited by examiner

METHOD OF MANUFACTURING MICRODISCHARGE DEVICES WITH ENCAPSULATED ELECTRODES

STATEMENT OF GOVERNMENT INTEREST

This invention was made with Government assistance under U.S. Air Force Office of Scientific Research grant Nos. F49620-00-1-0391 and F49620-03-1-0391. The Government has certain rights in this invention.

TECHNICAL FIELD

The present invention relates to microdischarge devices and, in particular, to nanoporous dielectric-encapsulated electrodes for use in such devices.

BACKGROUND

Microplasma (microdischarge) devices have been under development for almost a decade and devices having microcavities as small as 10 μm have been fabricated. Arrays of microplasma devices as large as $4*10^4$ pixels in ~4 $cm^2$ of chip area, for a packing density of $10^4$ pixels per $cm^2$, have been fabricated. Furthermore, applications of these devices in areas as diverse as photodetection in the visible and ultraviolet, environmental sensing, and plasma etching of semiconductors have been demonstrated and several are currently being explored for commercial potential. Many of the microplasma devices reported to date have been driven by DC voltages and have incorporated dielectric films of essentially homogeneous materials.

Regardless of the application envisioned for microplasma devices, the success of this technology will hinge on several factors, of which the most important are manufacturing cost, lifetime, and radiant efficiency. A method of device fabrication that addresses manufacturing cost and lifetime is, therefore, highly desirable.

SUMMARY OF THE INVENTION

In a first embodiment of the invention, a method for manufacturing microdischarge devices with encapsulated electrodes is provided. The method includes anodizing a metal substrate to form a nanoporous dielectric encapsulated electrode and dissolving a portion of the dielectric layer. The dielectric layer is then anodized a second time, resulting in a nanoporous dielectric encapsulated electrode with improved regularity of the nanoscale dielectric structures. In some embodiments of the invention, the columnar voids in the dielectric may be backfilled with one or more materials to further tailor the properties of the dielectric.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

The present application is related to U.S. patent application Ser. No. 10/958,175, entitled "Metal/Dielectric Multilayer Microdischarge Devices and Arrays", filed on the same day as this application, which is incorporated herein by reference.

In certain embodiments of the invention, a columnar nanostructured dielectric is grown on a metal substrate to form a microdischarge electrode. The metal substrate may have any form such as, for example, thin films, foils, plates, rods or tubes. This method facilitates fabricating microdischarge device arrays that will accommodate the shape of any surface. The dielectric is grown by first anodizing the metal substrate, which may be aluminum. A portion of the resulting dielectric layer is then dissolved (dissolution) and a second anodization step is then performed. The resulting dielectric structure is highly regular and nanoporous, having cylindrical cavities of high uniformity and diameters from tens to hundreds of nanometers. In some embodiments of the invention, the nanoscale cavities may then be backfilled with a given material (dielectric or electrical conductor) to further adjust the properties of the structure. The resulting encapsulated metals can demonstrate superior properties, such as high breakdown potential, as compared to conventional dielectric materials such as bulk materials and thin films.

Note that as used in this description and in any appended claims, unless context indicates otherwise, "layers" may be formed in a single step or in multiple steps (e.g., depositions).

Figure 1A:
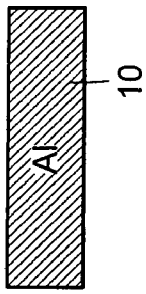
FIGS. 1A-1F show a diagram of a process for fabricating nanoporous encapsulated metal microplasma electrodes according to an embodiment of the present invention.
Figure 1B:
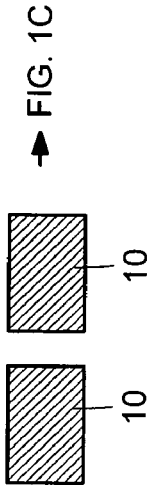
Figure 1C:
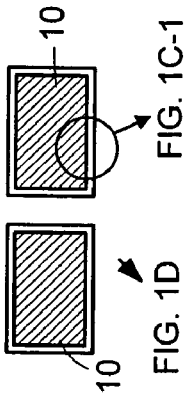

FIGS. 1A-1F illustrate a process for growing a nanoporous dielectric on a metal, in this case aluminum, according to an embodiment of the invention. A nanoporous dielectric layer 20 of $Al_2O_3$ can be grown on an aluminum substrate 10 in any form including, but not limited to: thin films, foils, plates, rods or tubes. The aluminum substrate should first be thoroughly cleaned by, for example, electrochemical or other chemical polishing methods, such as by subjecting the substrate to a bath of an acidic etchant such as perchloric acid (FIG. 1A). This process also serves to remove some irregularities from the surface, thereby making the surface flatter. The next step is to form microcavities of the desired cross-section and array pattern in the metal by one or more of a variety of techniques including microdrilling and chemical etching (FIG. 1B). (A microcavity is a cavity that has a characteristic dimension (diameter, length of a rectangle, etc.) approximately 500 μm or less). The dielectric deposition process is then initiated by anodizing Al 10 which yields a nanoporous surface 20 of $Al_2O_3$ (FIG. 1C) with columnar voids 25, but this surface has nanostructure that is irregular. The anodization can occur in an acidic solution with the metal substrate as the anode and a suitable material, such as graphite, copper, or platinum as the cathode. In one embodiment of the invention, the acidic solution is oxalic acid at a 0.3-0.4 M concentration and a temperature preferably less than about 15 degrees Celsius. The selection of the solution temperature represents a trade-off: a higher solution temperature causes the dielectric to deposit faster, but the dielectric structure is less regular. In other embodiments of the invention, sulphuric acid, phosphoric acid, chromic acid, or mixtures of organic and inorganic acids may be used as the anodizing solution.

Figures 1, 1C:
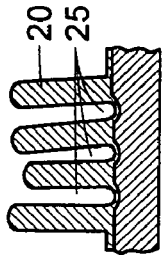
Figure 1D:
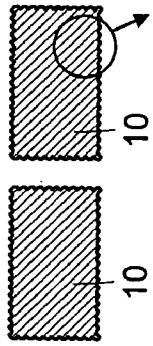
Figures 1, 1D:
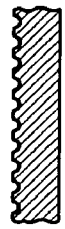
Figure 1E:
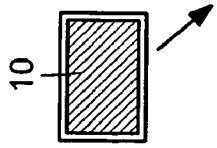

Next, removing the nanocolumns 20 by dissolution yields the structure shown in FIG. 1D. The dissolution may be accomplished, for example, by applying a mixture of chromic acid and mercuric chloride (or other alumina etchant solution such as Transetch N™) to the deposited dielectric. Anodizing the remaining structure, which can be considered a template, a second time results in the very regular structure of columnar voids 45 between columns of dielectric 40 shown in FIG. 1E. This second anodization may be accomplished in the same fashion as the first anodization, as described above. In specific embodiments of the invention, the thickness of this dielectric material 40 can be varied from hundreds of nanometers ("nm") to hundreds of microns. Furthermore, the diameter of the columnar voids 45 in the dielectric can be adjusted from tens to hundreds of nm by varying the solvent and anodization conditions (temperature and molar concentration).

The metal/nanostructured dielectric structure formed by this process may be used advantageously as electrodes in microplasma devices. The thickness of the nanoporous dielectric deposited on the various portions of an electrode can be tailored according to the properties desired in the device. For example, the thickness of the dielectric layer on portions of the electrode that will be adjacent to a microdischarge cavity may be set preferably in the range of 5 microns to 30 microns. A thicker dielectric layer increases the breakdown voltage of the dielectric and the lifetime of the dielectric against physical processes and chemical corrosion, but also increases the voltage required to ignite a discharge in the microcavity. Other portions of the electrode, not adjacent to the microcavity, may be advantageously covered with a thicker layer of dielectric, such as approximately 40 microns or more. This thicker layer of dielectric can extend the lifetime of the electrode, but also prevent electrical breakdown in regions outside the microcavities. The thickness of the dielectric layer formed on different portions of an electrode may be controlled by the use of a masking agent, such as a photoresist used in photolithography, or by other masking techniques as are known in the art. In some embodiments of the invention, the ratio of the thickness of the dielectric layer formed on the portions of an electrode that will contact a microdischarge cavity to the thickness of the dielectric layer on other portions of the electrode may be set to approximately 1:2 to 1:4.

Other materials may be substituted advantageously for aluminum in the preceding embodiment of the invention. For example, a variety of metals, such as titanium, tungsten, zirconium, and niobium may be used as a substrate on which to form a nanoporous dielectric by anodization. The process may be used to form a $TiO_2$ dielectric layer on titanium substrates and a $WO_3$ dielectric layer on tungsten substrates.

Figure 1F:
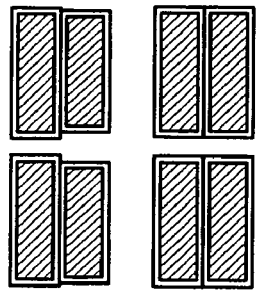
Figures 1, 1E:
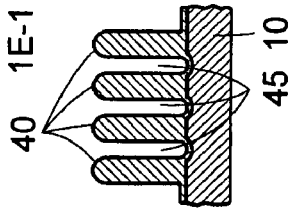

Once the fabrication of the electrode structures is completed, microplasma devices such as those illustrated in FIG. 1F may be assembled, according to an embodiment of the invention. Simple, two layer devices are shown, the top one of which has two microcavity diameters to facilitate alignment of the two electrodes. In the lower structure, the microcavity cross-sectional dimensions are approximately the same for both electrode structures. After the desired device structure is completed, the device is evacuated by a vacuum system and may be heated under vacuum to de-gas the structure. Subsequently, the microcavity (or microcavities) in the device (or array of devices) is back-filled with the desired gas or vapor and it is then generally desirable to seal the device or array by one of a variety of well-known processes such as anodic bonding, lamination or sealing with glass frit or epoxy. All of the microdischarge devices are powered by a time varying voltage that may be AC, RF, bipolar or pulsed DC. Electrical contact is made directly to the metal within the dielectric layer. Finally, the discharge medium may be produced by introducing to the microcavity a small amount of a metal-halide salt which, when heated by the operation of the microdischarge in a background gas, produces the desired vapor.

Figure 2:
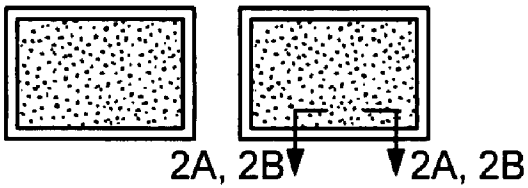
FIGS. 2A-2B are diagrams for further processing steps in the process shown in FIG. 1.
Figure 2B:
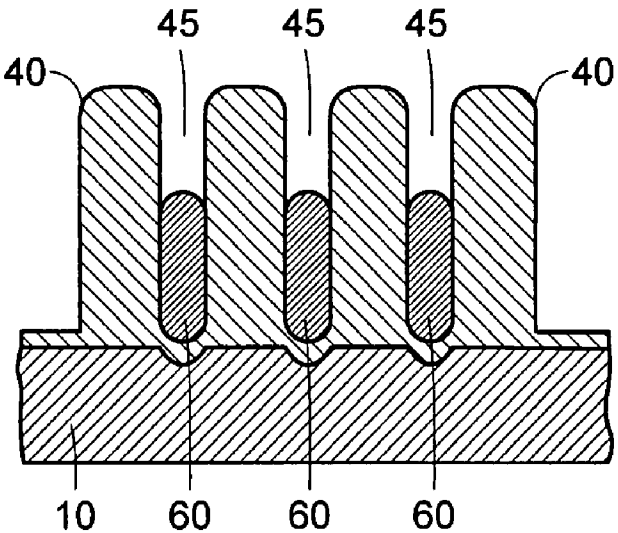
Figure 2A:
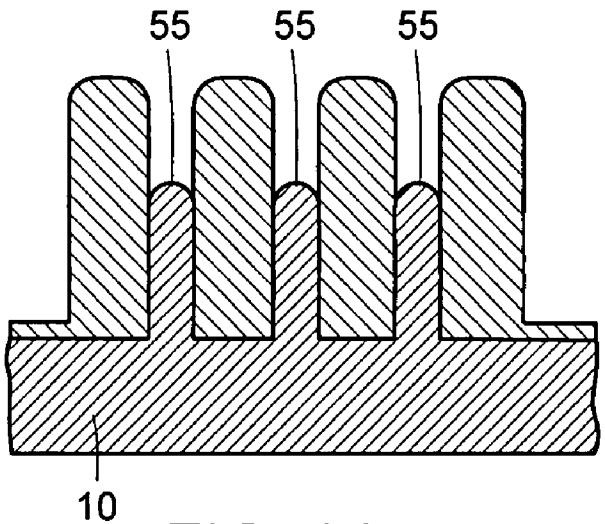

In a further embodiment of the invention, the properties of the encapsulated electrode of the preceding embodiments can be modified substantially with further processing. For example, as illustrated in FIG. 2B, the columnar pores 45 can be partially filled 60 with a material(s) such as magnesium oxide or other dielectric materials. This can be done by a variety of well-known processes such as sputtering, spin coating, chemical "dipping," and sol-gel processes. Thus, considerable flexibility may be achieved in tailoring the properties of the nanostructured dielectric. Properties that may be tailored in this manner include the dielectric constant of the dielectric and its electrical breakdown potential or optical properties. Alternatively, as illustrated in FIG. 2A, the $Al_2O_3$ "barrier" at the base of the nanopores, formed naturally in the anodization process, can be removed by chemical etching. One can then backfill the nanopores with a conducting material 55. Metals can be deposited into the nanopores by electroplating, for example. Any metal deposited onto the surface of the array can be removed, if desired, by etching. Also, carbon nanotubes may be grown within the nanopores by chemical vapor deposition. The nanotubes may be used to produce electrons by field emission. The electrons can be extracted from the open end of the nanopores by an electric field.

Figure 3:
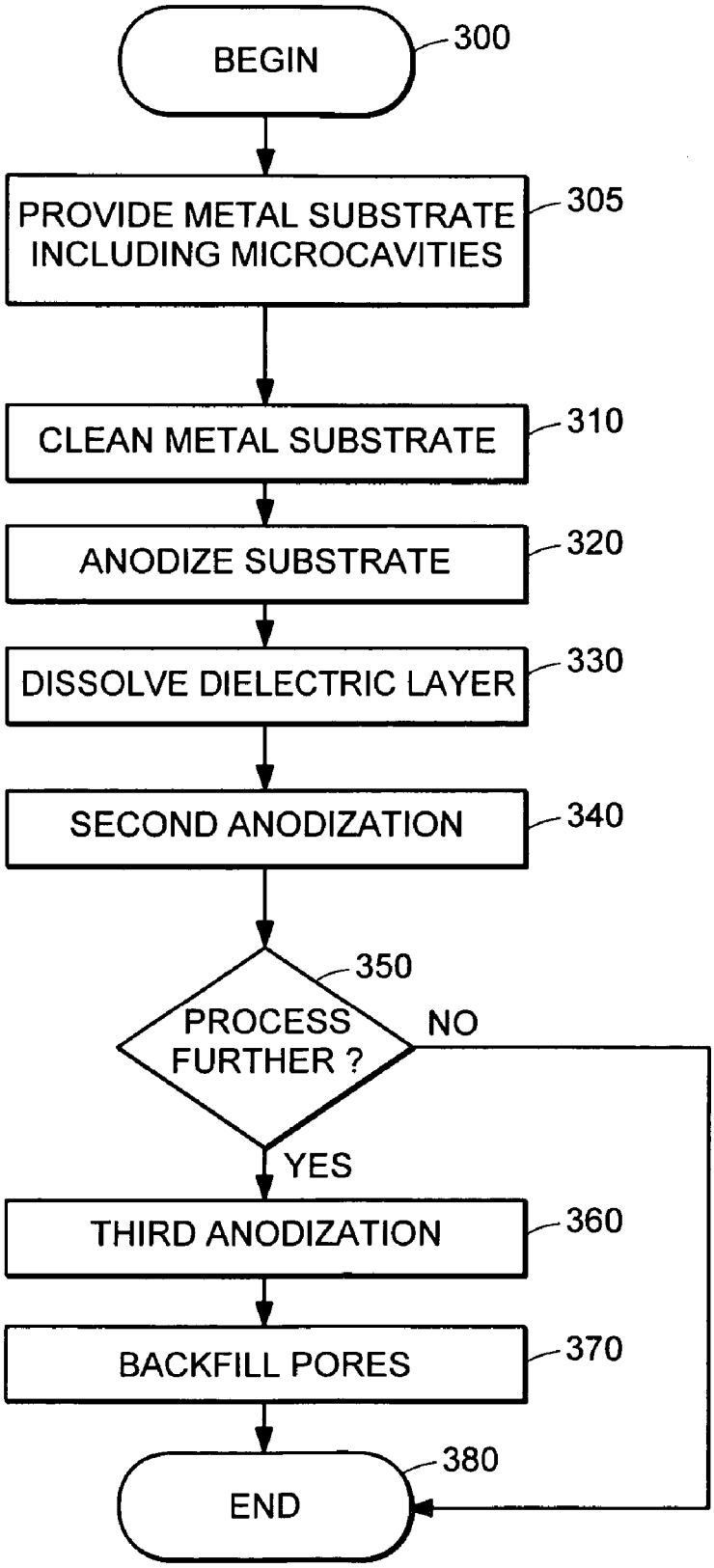
FIG. 3 shows a flow chart for the process illustrated in FIGS. 1A-1F and 2A-2B.

FIG. 3 illustrates a process 300 for forming a nanoporous dielectric encapsulated electrode according to an embodiment of the invention. First a metal substrate is provided that may include microcavities 305 and cleaned 310 as described above (see FIG. 1A). Next, the microcavity (or array of microcavities) is formed and, if necessary, debris removed by further cleaning (see FIG. 1B). Then, the substrate is anodized 320 (see FIG. 1C) and a nanoporous dielectric layer is deposited. Next, the deposited layer is partially dissolved 330 (see FIG. 1D). The substrate with the remaining dielectric layer template is then anodized 340 a second time (see FIG. 1E). If further processing is not required 350, the process ends 380. Alternatively, a third anodization may be performed 360 and the base of the columnar voids may be filled (see FIG. 2A) or the columnar voids can be backfilled with a desired material, as described above (see FIG. 2B). Microdischarge devices may be completed (not shown in FIG. 3) by filling the microcavity with the discharge medium and sealing the device.

The dielectric properties of the nanostructured dielectric are superior to those of dielectrics conventionally used in microplasma discharge devices. For example, the electrical breakdown voltage of a 20 μm thick layer of the $Al/Al_2O_3$ dielectric structure shown in FIG. 1 has been measured to be higher than 2000 V whereas twice that thickness (40 μm) of bulk alumina has a breakdown voltage of only ~1100 V. Also, thick barrier layers at the base of the nanopores and back-filling the pores with another dielectric are effective in increasing the breakdown voltage.

Figure 4:
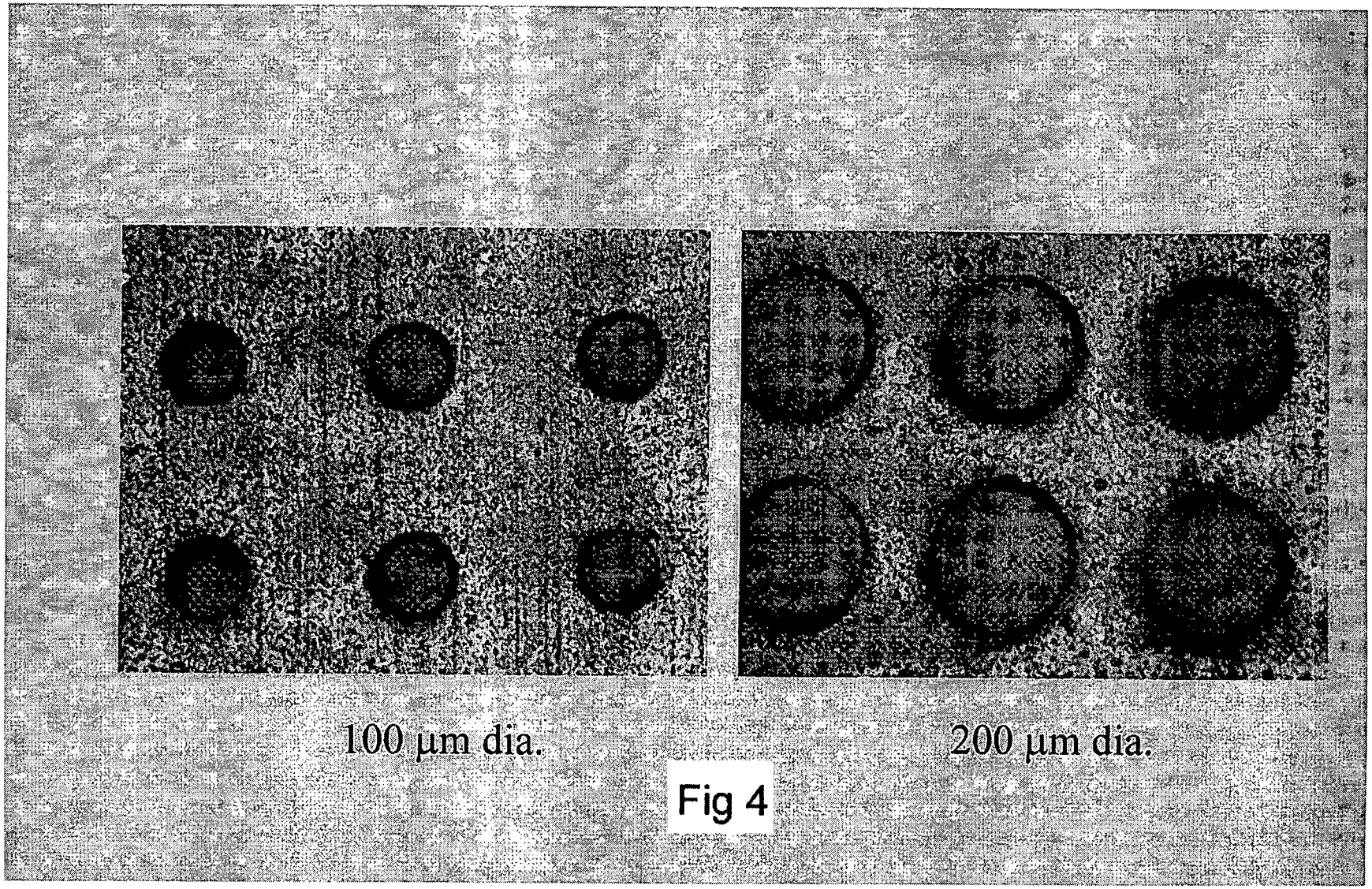
FIG. 4 shows arrays of 100 μm diameter and 200 μm diameter microdischarge devices fabricated in aluminum foil with an $Al_2O_3$ dielectric.

FIG. 4 shows optical micrographs of $Al/Al_2O_3$ microdischarge device arrays fabricated in the manner described above. On the left is shown six devices, each with microcavity diameters of 100 μm. The microcavities were produced in aluminum foil and extend through the foil. The $Al_2O_3$ dielectric lining the inner wall of each microcavity can be seen as a black ring. This dielectric film is, in reality, transparent but appears dark only because of the manner in which the photographs were recorded. The $Al_2O_3$ film on top (and on the reverse side) of the Al substrate is transparent and the speckling is the result of residual surface structure on the Al foil. The right-hand portion of FIG. 4 shows six microdischarge devices, also with cylindrical microcavities, but having diameters of 200 μm.

Figure 5:
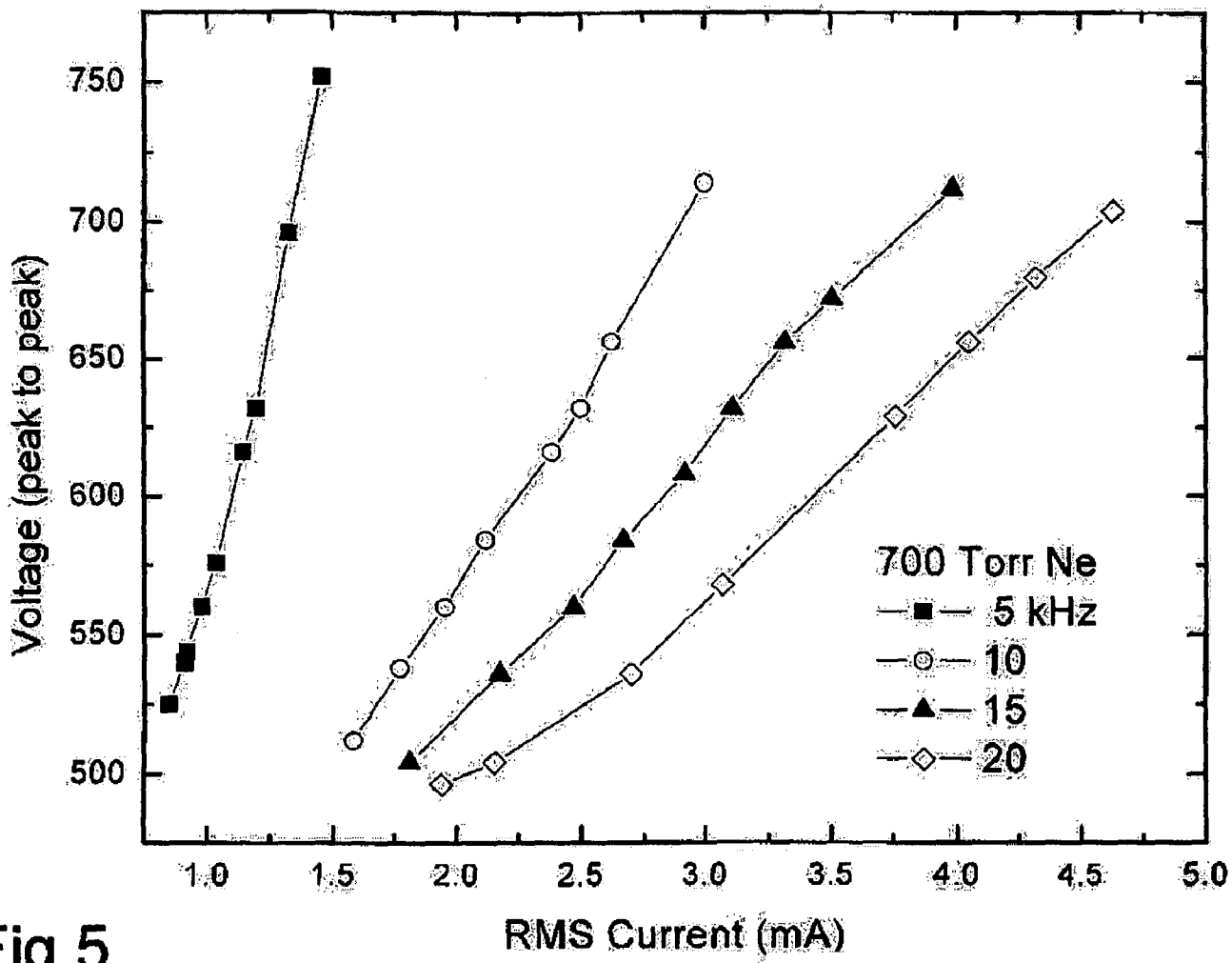
FIG. 5 shows voltage-current characteristics for 100 μm diameter $Al/Al_2O_3$ devices in neon at several values of the ac excitation frequency.
Figure 6:
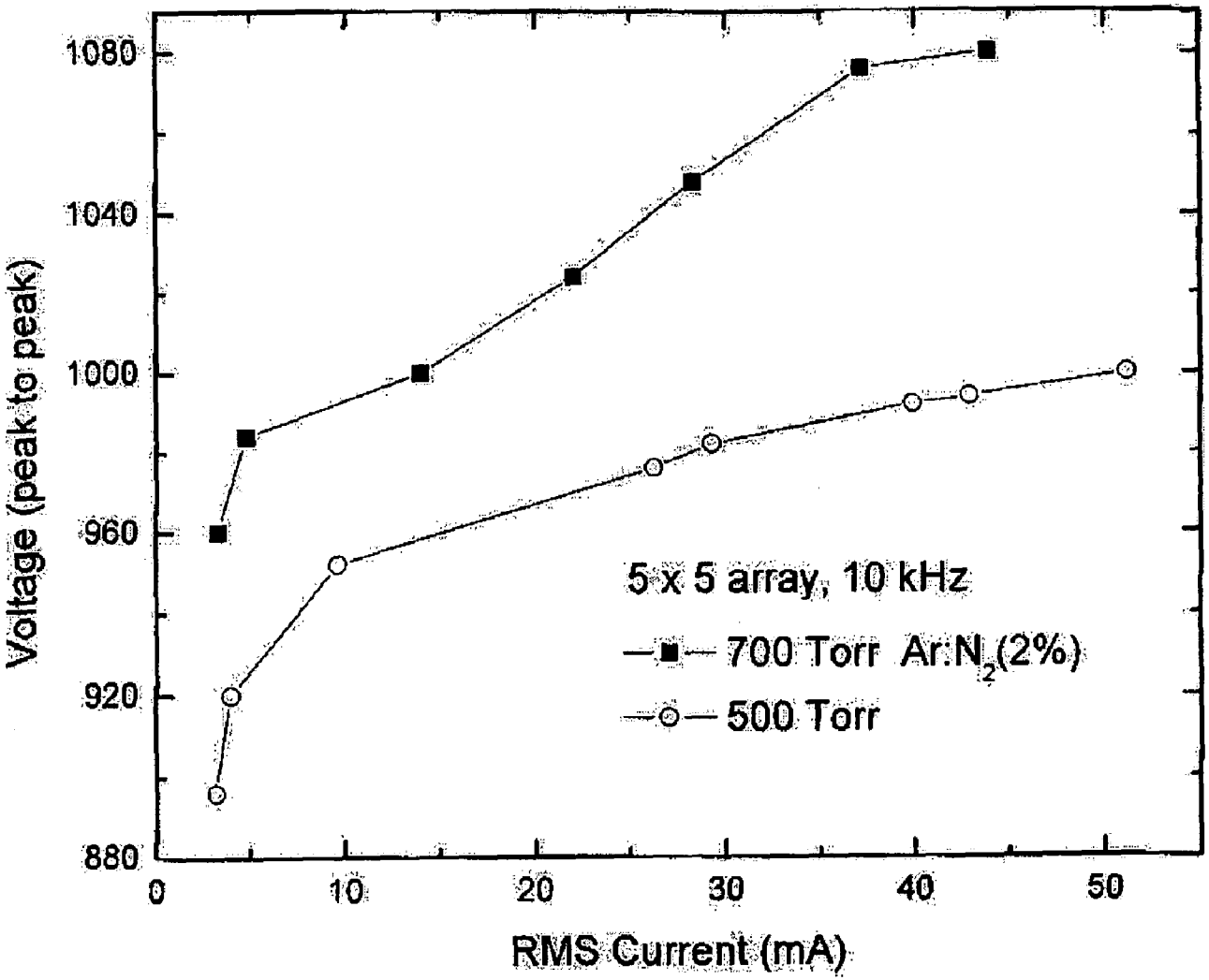
FIG. 6 shows voltage-current characteristics for 100 μm diameter $Al/Al_2O_3$ devices in an $Ar:N_2(2\%)$ mixture for two values of pressure.

Voltage-current ("V-I") characteristics for a small array of 100 μm $Al_2O_3$ devices are given in FIG. 5. The fill gas is Ne at a pressure of 700 Torr and results are shown for AC-excitation of the array at one of several frequencies. The voltage values on the ordinate are peak-to-peak values. And, it should be noted that the operating voltage can be reduced below those shown in FIG. 5 by reducing the $Al_2O_3$ thickness in the microcavity. V-I characteristics for a small array of $Al_2O_3$ microdischarge devices operating in Ar/2% $N_2$ mixtures are shown in FIG. 6 for two values of the total mixture pressure: 500 and 700 Torr. The operating voltages required are higher than those for Ne because of the attaching properties of $N_2$.

In other embodiments of the invention, microdischarge electrodes according to any of the preceding embodiments of the invention may be incorporated in microdischarge devices and device arrays. Further, microdischarge electrodes comprising metal substrates on which nanoporous dielectrics have been formed by other processes may be employed advantageously in microplasma devices and arrays.

Similarly, it is of course apparent that the present invention is not limited to the aspects of the detailed description set forth above. For example, the dielectric encapsulated metal may be used in a variety of applications beyond microdischarge electrodes. Various changes and modifications of this invention as described will be apparent to those skilled in the art without departing from the spirit and scope of this invention as defined in the appended claims.

What is claimed is:

1. A method for manufacturing an encapsulated electrode, the method comprising:

a. providing a metal substrate, the metal substrate including at least one microcavity;

b. anodizing the substrate to form a first layer, the first layer including pores;

c. dissolving a portion of the first layer; and d. performing a second anodization of the first layer when the portion of the first layer is dissolved, forming an encapsulating layer, thereby forming the encapsulated electrode.

2. A method according to claim 1, further including:

e. filling the pores of the encapsulating layer to a given depth with one of a metal, a dielectric and a nanotube.

3. A method according to claim 1, wherein the metal is aluminum and the encapsulating layer includes $Al_2O_3$.

4. A method according to claim 1, wherein the metal is titanium and the encapsulating layer includes $TiO_2$.

5. A method according to claim 1, wherein the thickness of the encapsulating layer differs between a first portion of the substrate and a second portion of the substrate.

6. A method according to claim 5, wherein the ratio of the thickness of the encapsulating layer formed on the first portion of the substrate to the thickness of the encapsulating layer formed on the second portion of the substrate is in the range from 4:1 to 2:1.

7. A method according to claim 1, wherein the thickness of the encapsulating layer formed on the microcavity in the substrate differs from the thickness of the encapsulating layer formed on a second portion of the substrate.

* * * * *